United States Patent [19]

Renaud

[11] 4,057,361

[45] Nov. 8, 1977

[54] CENTRIFUGAL PUMP

[75] Inventor: Georges Renaud, Nogent sur Marne, France

[73] Assignee: Societe Pompes Multiflux, Paris, France

[21] Appl. No.: 557,385

[22] Filed: Mar. 11, 1975

[30] Foreign Application Priority Data

Mar. 11, 1974 France ..... 74.08213

[51] Int. Cl.[2] ..... F04D 5/00; F01D 17/00

[52] U.S. Cl. ..... 415/53 R; 403/378; 415/131; 415/201; 415/211; 415/DIG. 3

[58] Field of Search ..... 415/131, 201, 53, 211, 415/DIG. 3; 403/378

[56] References Cited

U.S. PATENT DOCUMENTS

| | | | |
|---|---|---|---|
| 240,200 | 4/1881 | Thurston | 403/378 |
| 1,989,061 | 1/1935 | Longenecker | 415/53 R |
| 2,041,586 | 5/1936 | Barzen | 415/53 R |
| 2,265,758 | 12/1941 | Klosson | 415/201 |
| 2,347,386 | 4/1944 | Adams | 415/197 |
| 2,381,220 | 8/1945 | Longenecker | 415/53 |
| 3,045,603 | 7/1962 | Hunter | 415/53 |
| 3,167,021 | 1/1965 | Sence | 415/131 |
| 3,229,641 | 1/1966 | Hessler | 415/201 |
| 3,451,343 | 6/1969 | Kabele | 415/201 |
| 3,543,368 | 12/1970 | Marlow | 415/DIG. 3 |
| 3,841,791 | 10/1974 | Doolin | 415/DIG. 3 |

FOREIGN PATENT DOCUMENTS

| | | | |
|---|---|---|---|
| 704,304 | 2/1965 | Canada | 415/DIG. 3 |

*Primary Examiner*—C. J. Husar

*Attorney, Agent, or Firm*—Weiser, Stapler & Spivak

[57] ABSTRACT

A centrifugal pump, particularly for liquid fertilizer, whose casing has a central cavity housing an impeller in cantilever attachment to the end portion of a drive shaft. This drive shaft end portion forms a socket engaging the free end of the main drive shaft and is fixed thereto by retractable means.

9 Claims, 3 Drawing Figures

CENTRIFUGAL PUMP

This invention relates to a new form of centrifugal pump and particularly to that type which includes a self-priming means.

Recent economic developments have required rapid modernization and industrialization in all areas of activity, including a demand for higher performance in the field of liquid transfers for all sorts of applications such as the food and chemical industries, public works, excavating, hydrocarbons, swimming pools, etc.

Particularly in agriculture and in agricultural industries the most conspicuous development has taken place, involving the application and extremely rapid increase of liquid fertilizers, of fertilizer in suspension and of chemical products which have revolutionized the processes of fertilization and of plant sanitation.

Manufacturers have endeavored to modify and adapt their pumps to make them non-corroding. However, the products have rapidly become more complex, more concentrated and more corrosive, thereby continually creating considerable new difficulties in providing machinery and particularly their essential element: the pump.

In a few years, in the United States, as well as Europe and particularly France, large numbers of pumps were prematurely put out of operation.

Accordingly it is a prime object of the invention to provide a pump which is better suited to its technical and commercial requirements and which is particularly suitable for the transfer of liquids, of various viscosities, and bearing a high percentage of solid particles.

This and other objects which will appear are achieved in accordance with the invention by means of a centrifugal pump having a pump casing enclosing a central cavity which houses an axial impeller. This impeller is cantilevered to a drive shaft end portion. This end portion is socket shaped and engages, with little or no play, the free end of the main drive shaft. It is fixed for rotation together with the main drive shaft by retractable attaching means. Externally actuatable locking means are provided for adjusting the axial position of that end socket relative to the main drive shaft, so as to adjust the spacing between the turbine and the wall of the central cavity opposite the drive shaft.

Preferably the axial position adjusting means for the end socket includes a radial screw, which is screwed to the socket traversing its wall and has, on its end face, an eccentric lug engaging a circular grove in the main drive shaft. This end socket can slide axially, relative to the main drive shaft, upon retraction of the attaching means.

For further details and advantages of the invention reference may be had to the description of an embodiment thereof which follows in the light of the accompanying drawing wherein.

Figure 1:
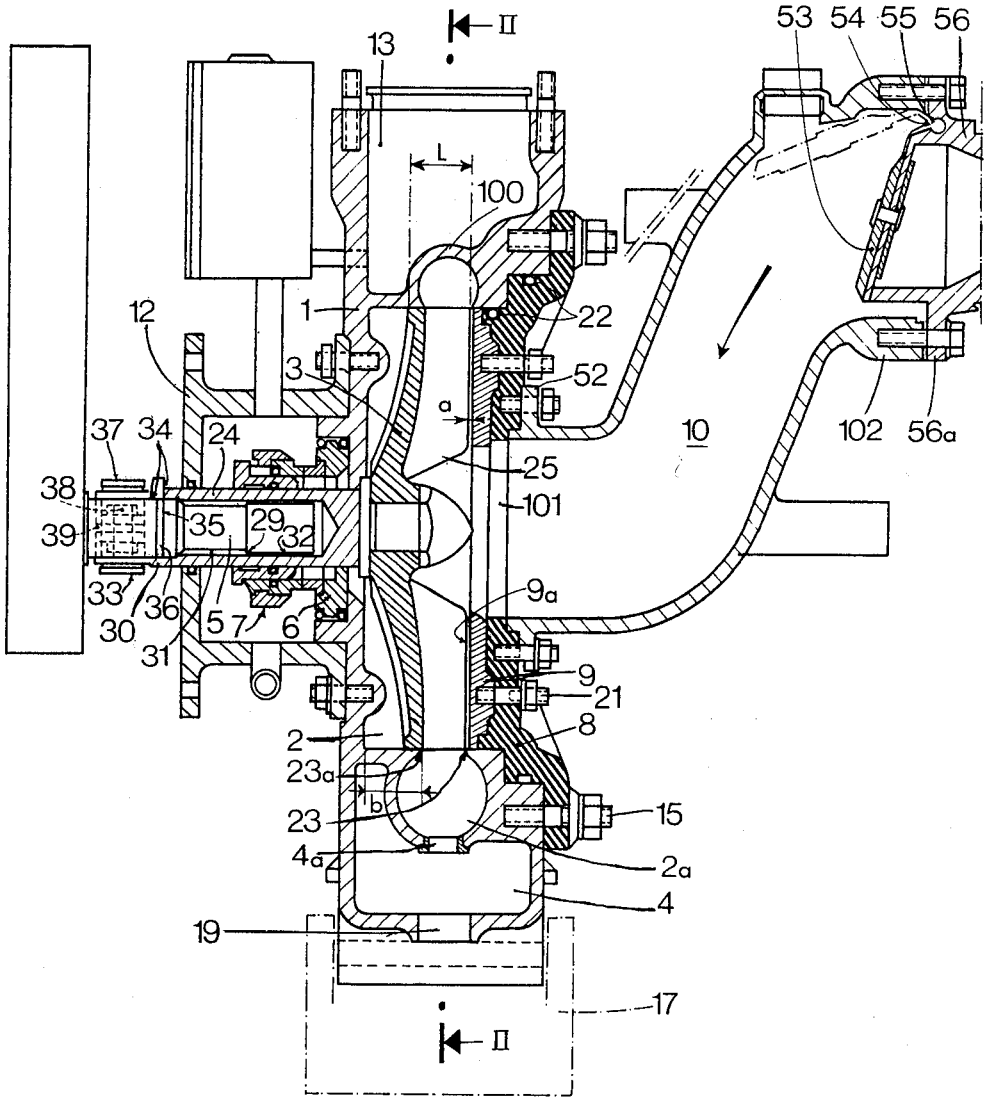
FIG. 1 is an elevational cross-section, taken through the axis, of a centrifugal pump embodying the invention.

Referring to the drawings, these show a centrifugal pump including a pump casing 1 enclosing a central cavity 2 which houses an axial suction impeller 3 screwed in cantilever manner to the end of a drive shaft 5, 24. The drive shaft end portion 24 consists of a cylindrical socket which engages with little or no play the free end of the main drive shaft 5. It is fixedly attached to that shaft 5 for rotation with it by retractable attaching means further described below.

The central cavity 2 is made liquid-tight around the shaft 5, 24 by a system of fixed seals 6 and mobile seals 7 within a housing 12 filled with anti-freeze barrier liquid. These seals 6 and 7 are made of materials appropriate to the type of usage made of the pump.

According to the invention lockable control means controllable from outside are provided to adjust the axial position of the socket portion 24 relative to the main drive shaft portion 5 so as to adjust the spacing "a" prevailing between impeller 3 and wall 8, 9 opposite drive shaft 5, 24 in central cavity 2.

As can be seen in FIG. 1, the means for adjusting the axial position of socket 24 include a radial screw 34 screwed to said socket 24 and traversing its wall. This screw has, on its end face an eccentric lug 35 engaging a circular groove 36 in the main drive shaft portion 5. Socket 24 can slide axially on shaft 5 when the means for fixedly attaching the latter to such shaft 5 are retracted. These attaching means are preferably constituted by a collar 37 encircling the open end of the socket 24, which open end is provided with longitudinal slots 39. Collar 37, which may be formed of two half-collars attached to each other by two high-strength bolts 38, further constitutes a torque limiter between the main drive shaft portion 5 and impeller 3. This torque limiter prevents damage to the impeller in case its rotation is blocked by a foreign body.

Socket 24 is made of a metal with high resistance to corrosion, such as stainless steel and also serves as a mantle for shaft 5 which is preferably made of a single piece of hard metal such as steel treated for high strength. Shaft 5 may comprise two larger diameter portions, or collars 29 and 30 of different diameters spaced from each other by a narrower, or relief portion 31. Two thin and self-lubricating rings, or bushings, 32 and 33 encircle the collars 29 and 30, thereby facilitating the axial sliding of the socket 24 on shaft 5.

Screw 34, which is positioned outside liquid tight housing 12, is provided on its head with a fiduciary mark. The eccentric lug 35 and groove 36 are such that a half turn of screw 35 corresponds to the maximum play available between impeller 3 and the forward wall 8, 9 of the central cavity 2.

In addition to central cavity 2, the pump casing 1 encloses a self-priming ring surrounding said central cavity 2 and communicating, at its lower end, with both said central cavity 2 through a self-priming orifice **4*a* and with the outside through a relief orifice 19.**

Figure 2:
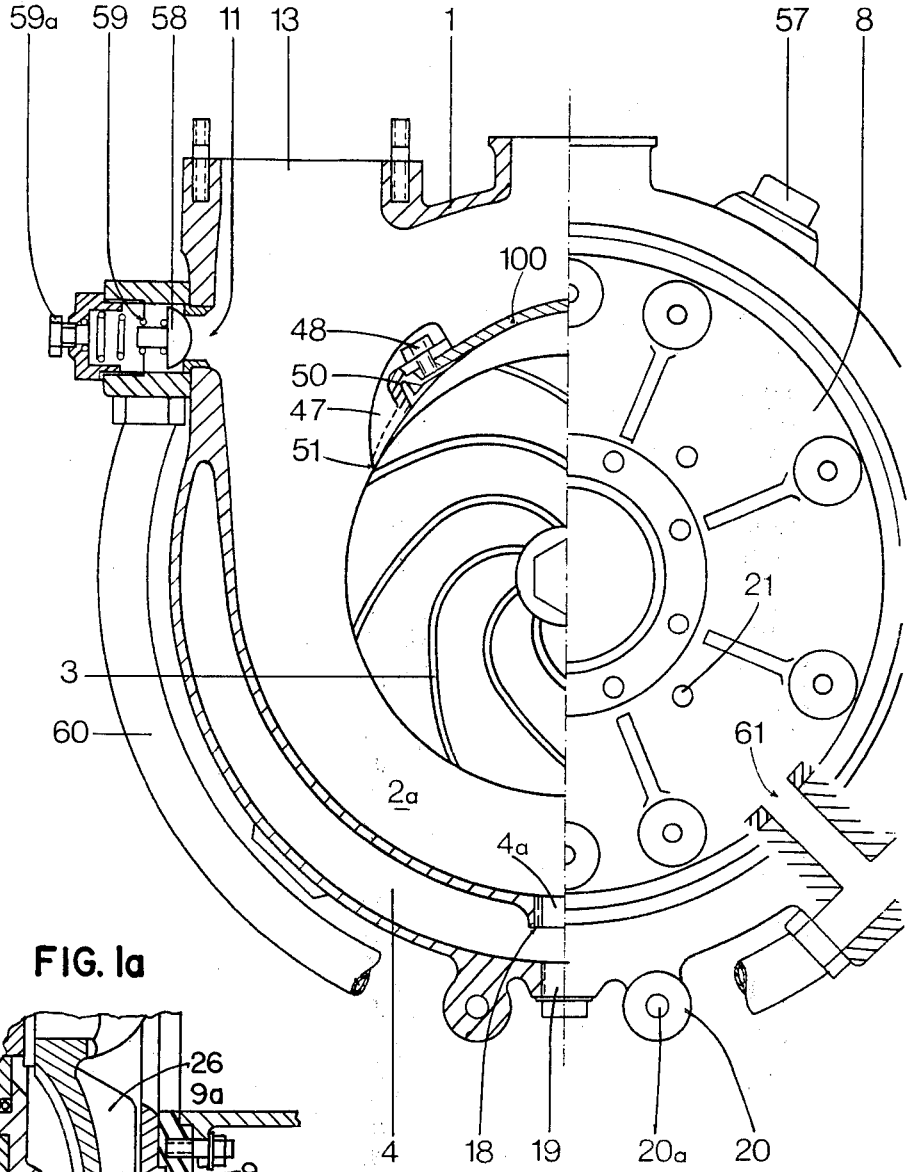
FIG. 2 is a half-section elevation through II — II of FIG. 1.

A partition 100 separates central cavity 2 from ring 4. At the extremity closest to impeller 3 this partition has a fin 47 of hard metal which is attached to the separating partition 100 by being clamped to the latter through nut and bolt 48 of stainless steel. Fin 47 has two flats which provide the bearing surfaces for clamping said piece 47. They are so shaped that the piece can be attached to the separating partition in two different orientations relative to a plane tangential to the periphery of impeller 3 at the location of fin 47. This permits adapting aperture 51 in fin 47 to the type of liquid being pumped, aperture 51 being the space left between the free end of fin 47 and the periphery of impeller 3 (See FIG. 2).

Preferably, self-priming aperture 4a is constituted by a removable threaded socket 18 screwed to partition 100 and traversing the latter. Socket 18 preferably has a diameter no greater than that of relief orifice 19 so that it may be inserted into ring 4 and screwed to wall partition 100 through that orifice 19.

The pump casing is of circular form and further has a series of protrusions 20 regularly spaced around the periphery of the casing. Each protrusion 20 is provided with a hole 20a extending through it and enabling the attachment of the casing 1 to a support 17 in various angular positions of rotation around its axis.

Central cavity 2 is closed on the side opposite drive shaft 5, 24 of turbine 3 by a removable liquid-tight circular lid 8 co-axial with impeller 3.

It closes an opening in the pump casing 1 whose diameter is preferably at least slightly greater than that of impeller 3 and which has both a central suction aperture 101 extending through it and, on its inside face, a removable wear plate 9. Cover 8 is attached to casing 1 by eight studs 15 which allow its rotation in increments of 45°.

Cover 8 can therefore be easily removed to provide ready access to impeller 3 without having to disassemble the pump entirely. Wear plate 9 is made of a high-strength casting, either treated to be stainless or enameled. Wear plate 9 is attached to cover 8 by four studs 21. Liquid tight closure by cover 8 for casing 1 is provided by toroid seals 22. The thickness of wear plate 9 is so chosen that its face 9a lines up in the same plane as the front face 23 of the wall defining an enlarged peripheral portion 2a in the form of a volute within central cavity 2.

There is attached to cover 8, removably and orientably around the axis of pump casing 1, a suction pipe 10 by means of a flange 52. This pipe is bent upwardly near flange 52 and then bent the other way so as to have two horizontal extremities.

Preferably flange 52 has the same configuration of holes as that of flange 56a for attaching to pipe 10 a fixed suction pipe 56 at the end opposite cover 8. This requires that the two flanges of pipe 10 have the same hole configuration. This makes it possible to attach a suction pipe either directly to cover 8 of pump casing 1 or to the free end of suction pipe 10, depending upon the application.

At the end of suction pipe 10 opposite cover 8 an antisyphon valve 53 is provided which pivots at its upper end about a stainless steel shaft 54 rotatably journalled in a recess 55 provided in flange 56a of mouth 56 and stopped by flange 102 of pipe 10.

Thus, due to its particular positioning at the end of pipe 10, valve 53 can retract completely out of the path of liquid to be pumped without reducing the normal suction aperture.

A threaded port 57, normally closed by a plug, makes it possible to rinse the pump in fixed installations by water injection.

In addition a rinsing and unclogging arrangement is provided which includes a one-way valve 58 closing a lateral orifice 11 at the outlet 13 of the pump. Valve 58 is calibrated to adjustable pressures by a spring 59 provided with an adjusting bolt 59a. A flexible armored tube 60 provides communication between the downstream side of valve 58 and volute 2a via channel 61. This arrangement further provides an automatic pressure regulator without changing the distribution adjustment when the speed of the pump varies in use on mobile machinery.

Figure 1A:
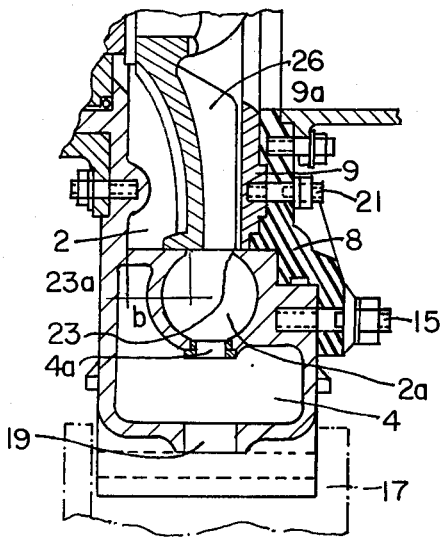
FIG. 1*a* shows a fragmentary portion of the structure of FIG. 1 illustrating an alternative form of that structure.

FIGS. 1 and 1a respectively show two impellers 25, 26 of different characteristics, each representing a type of impeller which can be mounted within the pump. Impeller 25 has wide vanes and can be utilized to obtain high volume. Impeller 26 has narrower vanes and can be utilized to obtain high pressures. Note the thicker rear shroud of impeller 26 which has narrower blades than impeller 25. Mounting of impellers having the same diameter but different vane widths is possible because of sufficient spacing "b" between rear face 23a of the partition defining the collar of volute 2a and the bottom of central cavity 2 on the side facing shaft 5, 24.

An important feature of the present invention is the provision of impellers having different volume and pressure characteristics and interchangably mountable without any special adjusting means. This is accomplished by making the outer circumferential portion of impellers 25, 26 with a dimension L which covers the entire aperture of volute 2a regardless of how wide the vanes may be.

It will be understood that various other modifications will occur to those skilled in the art without departing from the scope of the invention.

I claim:

1. In a single stage centrifugal pump having a casing enclosing a cavity housing an axial suction impeller, said impeller being cantilevered to a drive shaft and laterally displaceable, and said cavity including an enlarged peripheral volute portion, the improvement wherein said cavity is constructed to receive impellers having blades whose widths vary over a predetermined range, the outside circumference of the impeller has a width which covers substantially the entire opening of said volute portion for all different widths of said range and the rear shroud has increased thickness as blade width decreases, and the volute portion being free of provisions for adjustment of its width.

2. In a single-stage centrifugal pump having a casing enclosing a cavity housing an axial suction impeller, said impeller being cantilevered to a drive shaft and laterally displaceable, and said cavity including an enlarged peripheral volute portion, the improvement wherein said cavity is adapted to receive impellers having blades of different widths, the outside circumference of the impeller has a width which covers substantially the entire opening of said volute portion for all different widths of said impeller blades, said drive shaft comprises a main portion and an end portion, said end portion having a socket means engaging said main portion and means for fixing said socket means to said main portion, said fixing means being retractable, and means for adjusting the axial position of said end portion relative to said main portion to adjust the spacing between said impeller and the wall of said cavity opposite said drive shaft, said adjusting means being lockable and externally controllable and comprising a radial screw, screwed to said socket means and traversing the wall of said socket means, said screw having on its end face an eccentric lug engaging a circular groove in said main drive shaft portion, whereby said socket means is capable of sliding axially on said mean drive shaft portion upon retraction of said fixing means.

3. In a single-stage centrifugal pump having a casing enclosing a cavity housing an axial suction impeller, said impeller being cantilevered to a drive shaft and laterally displaceable, and said cavity including an enlarged peripheral volute portion, the improvement wherein said cavity is adapted to receive impellers having blades of different widths, the outside circumference of the impeller has a width which covers substantially the entire opening of said volute portion for all different widths of said impeller blades, a self priming ring encircling said cavity, and a self priming orifice communicating between said ring and cavity at the lower extremity of said ring, said orifice being formed of a removable socket, said casing is of generally circular form and provided with means for positioning it in several angular positions azimuthally about its axis, and further comprising a cover for closing said cavity on the side opposite said drive shaft, said cover being removable and provided with a removable wear plate and having a central suction aperture, and a suction pipe removably attached to said cover and azimuthally orientable around the axis of said pump casing, a flange for attaching said pipe to said cover, said pipe having an upwardly bent elbow and having at its opposite end a flange with the same configuration of holes as said flange for attaching the pipe to the cover.

4. The pump of claim 3 wherein the end of said pipe remote from said casing contains an antisyphon valve, said valve being pivotable at its upper end about a shaft journalled within a recess, the excursion of said valve being limited by said suction pipe.

5. In a single-stage centrifugal pump having a casing enclosing a cavity housing an axial suction impeller, said impeller being cantilevered to a drive shaft and laterally displaceable, and said cavity including an enlarged peripheral volute portion, the improvement wherein said cavity is constructed to receive impellers having blades whose widths vary over a predetermined range, the outside circumference of the impeller has a width which covers substantially the entire opening of said volute portion for all different widths of said range, the volute portion being free of provisions for adjustment of its width, said drive shaft comprises a main portion and an end portion, said end portion having a socket means engaging said main portion and means for fixing said socket means to said main portion, said fixing means being retractable, and means for adjusting the axial position of said end portion relative to said main portion to adjust the spacing between said impeller and the wall of said cavity opposite said drive shaft, said adjusting means being lockable and externally controllable.

6. In a single-stage centrifugal pump having a casing enclosing a cavity housing an axial suction impeller, said impeller being cantilevered to a drive shaft and laterally displaceable, and said cavity including an enlarged peripheral volute portion, the improvement wherein said cavity is constructed to receive impellers having blades whose widths vary over a predetermined range, and the outside circumference of the impeller has a width which covers substantially the entire opening of said volute portion for all different widths of said range, the volute portion being free of provisions for adjustment of its width said central cavity has an encircling wall at whose end nearest said turbine there is a hard metal fin, said fin being attached to said wall by clamping means and having a plurality of bearing flats for said clamping means, the relationship between said flats and said fin being such that said fin can be positioned on said wall in different orientations relative to a plane tangential to the periphery of said turbine at the location of the said fin.

7. In a single-stage centrifugal pump having a casing enclosing a cavity housing an axial suction impeller, said impeller being cantilevered to a drive shaft and laterally displaceable, and said cavity including an enlarged peripheral volute portion, the improvement wherein said cavity is constructed to receive impellers having blades whose widths vary over a predetermined range, the outside circumference of the impeller has a width which covers substantially the entire opening of said volute portion for all different widths of said range, the volute portion being free of provisions for adjustment of its width, a self priming ring encircling said cavity, and a self priming orifice communicating between said ring and cavity at the lower extremity of said ring, said orifice being formed of a removable sleeve.

8. In a single-stage centrifugal pump having a casing enclosing a cavity housing an axial suction impeller, said impeller being cantilevered to a drive shaft and laterally displaceable, said cavity including an enlarged peripheral volute portion, the improvement wherein said cavity is constructed to receive impellers having blades whose widths vary over a predetermined range, and the outside circumference of the impeller has a width which covers substantially the entire opening of said volute portion for all different widths of said range, said drive shaft comprises a main portion and an end portion, said end portion having a socket means engaging said main portion and means for fixing said socket means to said main portion, said fixing means being retractable, and means for adjusting the axial position of said end portion relative to said main portion to adjust the spacing between said impeller and the wall of said cavity opposite said drive shaft, said adjusting means being lockable and externally controllable, said retractable fixing means comprising a collar encircling the open end of said socket means, said end being provided with at least one longitudinal slot.

9. The pump of claim 8 wherein said socket means is of corrosion resistant metal and said main drive shaft portion is of one-piece hard metal.

* * * * *